US008752297B2

(12) United States Patent
Rohrbach

(10) Patent No.: US 8,752,297 B2
(45) Date of Patent: Jun. 17, 2014

(54) KNIFE

(75) Inventor: Martin Rohrbach, Horn (DE)

(73) Assignee: Martor KG, Solingen (DE)

( * ) Notice: Subject to any disclaimer, the term of this patent is extended or adjusted under 35 U.S.C. 154(b) by 838 days.

(21) Appl. No.: 12/670,947

(22) PCT Filed: Jan. 31, 2009

(86) PCT No.: PCT/DE2009/000127
§ 371 (c)(1),
(2), (4) Date: Jan. 27, 2010

(87) PCT Pub. No.: WO2009/095002
PCT Pub. Date: Aug. 6, 2009

(65) Prior Publication Data

US 2011/0119925 A1 May 26, 2011

(30) Foreign Application Priority Data

Jan. 31, 2008 (DE) ..... 10 2008 007 090
Apr. 17, 2008 (DE) ..... 10 2008 019 441

(51) Int. Cl.
*B26B 1/00* (2006.01)
*B26B 3/06* (2006.01)

(52) U.S. Cl.
USPC ..... 30/158; 30/154; 30/335; 30/337

(58) Field of Classification Search
CPC ..... B26B 5/003; B26B 1/02; B26B 1/08
USPC ..... 30/154, 162, 164, 335, 337, 158
See application file for complete search history.

(56) References Cited

U.S. PATENT DOCUMENTS 6,148,520 A 11/2000 Berns ..... 30/2
2002/0124412 A1 9/2002 Votolato ..... 30/200

(Continued)

FOREIGN PATENT DOCUMENTS

DE 202004011913 11/2004

*Primary Examiner* — Kenneth E. Peterson
*Assistant Examiner* — Samuel A Davies
(74) *Attorney, Agent, or Firm* — Andrew Wilford

(57) ABSTRACT

The invention relates to a knife, comprising a blade carrier (14) for holding a blade (15), having at least one primary knife part (11) and a secondary knife part (12), which is configured to be movable relative to the primary knife part (11), wherein the primary knife part (11) is associated with first coupling means (20, 36), which can be detachably engaged with second coupling means (18, 38) associated with the secondary knife part (12) in order to move the blade carrier (14) by way of a motion of the primary knife part (11) relative to the second knife part (12) between a safety position, in which the blade (15) is retracted into a knife housing (11) configured by the primary knife part (11) and/or the secondary knife part (12) and inaccessible to the user, and an intermediate position, in which the blade (15) protrudes from the knife housing (11), wherein the blade carrier (14) is subjected to a load by a restoring force (21) in the safety position. The special characteristic is that the blade carrier (14) is pivotally mounted about a fixedly disposed rotational axis (a2), that by the action of a cutting force (F) on the blade (15) the blade carrier (14) can be moved out of the intermediate position into a cutting position, and that in the cutting position the first coupling means (20, 36) and the second coupling means (18, 38) are detached from each other such that the blade carrier (14) can be moved into the safety position.

15 Claims, 6 Drawing Sheets

(56) References Cited

U.S. PATENT DOCUMENTS

2004/0237312 A1* 12/2004 Hernandez et al. ..... 30/162
2007/0277382 A1* 12/2007 Okada ..... 30/162
2008/0083119 A1 4/2008 Schmidt ..... 30/162
2008/0163493 A1 7/2008 Votolato ..... 30/154

* cited by examiner

KNIFE

CROSS REFERENCE TO RELATED APPLICATIONS

This application is the US-national stage of PCT application PCT/DE2009/000127, filed 31 Jan. 2009, published 6 Aug. 2009 as WO2009/095002, and claiming the priority of German patent application 102008007090.4 itself filed 31 Jan. 2008 and German patent application 102008019441.7 itself filed 17 Apr. 2008.

FIELD OF THE INVENTION

The invention relates to a knife having a blade support holding a blade and having at least one primary knife part and a secondary knife part movable relative to the primary knife part, the primary knife part being associated with a first coupling that can detachably engage a second coupling associated with the secondary knife part (12) in order to move the blade support as a result of movement of the primary knife part relative to the secondary knife part between a safety position in which the blade is retracted into a knife housing formed by the primary knife part and/or the secondary knife part and inaccessible to the user, and an intermediate position in which the blade projects from the knife housing, the blade support being prestressed by a return force into the safety position.

BACKGROUND OF THE INVENTION

Such a knife is known from DE 197 23 279 [U.S. Pat. No. 6,148,520]. A blade support is mounted for shifting in the housing between a position retracted into and a position projecting from the housing. In the forward position the blade projects from the housing. An operating part has a primary coupling element that can be engaged with and disengaged from a secondary coupling element of the blade support in order to move the blade support from the retracted position into the projecting position.

Forward movement of the operating part is limited. With regard to this frontmost position of the operating part the blade support is allowed an additional relative movement by means of which the primary and the secondary coupling element may be disengaged from each other. The blade support may therefore be retracted back into the housing via a spring with decreasing cutting force on the blade.

OBJECT OF THE INVENTION

Based on DE 197 23 279 it is the object of the invention to create a safety knife having additional advantages with regard to the production, installation and functional safety, as well as operational safety.

SUMMARY OF THE INVENTION

The problem is solved by a knife where the blade support is pivoted at a fixed axis such that a cutting force on the blade moves the blade support out of the intermediate position into a cutting position, and that in the cutting position the first coupling and the second coupling are disengaged from each other such that the blade support can move into the safety position.

The principle of the invention is that the knife has a blade support that can pivot about a fixed axis between a safety position, an intermediate position, and a cutting position. The blade support is prestressed into the safety position by a return force. In the safety position the blade is held in an inaccessible manner within the housing. In the intermediate position and in the cutting position the blade projects from an opening of the housing.

The blade support may be moved out of the safety position into the intermediate position by movement of a primary knife part toward a secondary knife part. The relative movement may mean any type of movement within the sense of the invention, such as a pivoting or a straight-line movement.

A first coupling is associated with the primary knife part and can be engaged with and disengaged from second coupling associated with the secondary knife part. The first coupling may be directly or indirectly connected, for example, to the primary knife part. In the same manner the second coupling may be directly or indirectly connected, for example, to the secondary knife part.

An actuator having actuating means, comprising for example the primary and the second knife part, can be moved between a starting position and an actuated position by relative movement of the primary knife part and the secondary knife part toward each other. The actuator may, for example, be prestressed into the starting position by a return force. By moving the actuator from the starting position into the actuated position the first and the second coupling can be detachably engaged.

If the primary knife part is moved relative to the secondary knife part from the starting position into the actuated position, the first coupling and the second coupling engage, since the first coupling is located in the movement path of the second coupling. As soon as the couplings are engaged the blade support is also moved with further movement of the actuator. It is also possible, for example, that the couplings are already engaged in the starting position. With movement of the primary and the secondary knife parts from the starting position into the actuated position, the blade support is moved for example from the safety position into the intermediate position. In the intermediate position the blade projects from the housing.

While the actuated position of the primary and secondary knife parts may be, for example, a defined end position, the blade support is allowed to carry out an additional pivoting movement toward the cutting position with regard to the intermediate position. The additional pivoting movement of the blade support toward the cutting position may be caused, for example, by a cutting force. With movement of the blade support from the intermediate position into the cutting position the first and the second couplings are disengaged.

With movement of the blade support into the cutting position the primary and the secondary knife part do not necessarily have to remain in the actuated position. Movement of the primary and of the secondary knife parts enabling the release of the coupling is also conceivable.

After disengaging the first and the second coupling, the movement path of the blade support is free for retraction into the safety position. As soon as the cutting force is lower than the return force of the blade support the blade support pivots back into the safety position. If, for example, the blade leaves the goods being cut, the blade support may move back into the safety position if the first and the second couplings are separated from each other, although the actuator is located in the actuated position.

The knife housing may be formed by the primary and/or the secondary knife part.

The axis of the blade support is fixed. The pivot may be for example on the primary knife part, or alternatively on the second knife part. According to a further alternative the pivot may be on both knife parts.

The advantage of the invention is that the pivotal blade support does not need to be displaced significantly on the housing. It is thus less susceptible to any fouling of the housing and the drive elements optionally arranged therein. Furthermore, there is no great distance traveled between the safety position and the cutting position, but merely a very small pivoting angle instead. Thus the blade support may be moved quickly from the safety position into the intermediate position. After separating from the coupling the blade support also moves rapidly back into the safety position.

Since the blade support is pivoted the housing does not need to have any guide structure for displacement of the bearing of the blade support in the knife longitudinal direction. The housing may therefore be configured in a simpler manner with regard to its construction. The knife still provides an unlimited safety function in that the blade is automatically retracted into the housing on leaving the goods to be cut, although the actuator remains in the actuated position.

According to a first embodiment, the first coupling or the second coupling is associated with the blade support. If, for example, the first coupling is associated with the blade support, the blade support is supported, for example, on the primary knife part, thus being connected to the knife part.

According to a further embodiment the first coupling or the second coupling is associated with actuating means for actuating the blade support. The actuating means may, for example, be fixed on one of the knife parts, or may be alternatively be movable on at least one of the knife parts. For example, the coupling may be a link.

According to a further embodiment, the actuating means are associated with a lever having a fixed axis. The lever may be, for example, the primary knife part that is supported on the secondary knife part at a fixed axis. For example, the first or the second coupling may be connected to the lever. The lever may be, for example, a two-armed lever. In this manner it is possible to make safety knives like pliers, and to manually actuate, for example, a first lever arm. The coupling may be associated with a second lever arm of the two-armed lever. Pivoting of the lever engages the couplings and pivots the blade holder.

In a further embodiment the actuating means comprise at least one link. The link may be displaceably supported in a slot, for example, at its end. For example, a bolt firmly connected to the link may be guided in the slot. The link may be, for example, a rigid rod.

According to a further embodiment, the actuating means form a transmission. For example, forces and movements of the coupling parts may be converted. For example, the blade support can be rapidly movable between the safety position, the intermediate position, and the cutting position by the conversion. Furthermore, the coupling can move the blade support, for example, through a desired movement if the primary knife part is moved relative to the secondary knife part. The blade support may form a part of the coupling.

According to a further embodiment the coupling is formed by a link mechanism. For example, a first link of the assembly may be formed by the blade support. A second link may be connected, for example, to the blade support and to one of the knife parts. The first or the second coupling may be associated with a link of the link mechanism. The first or the second coupling may form part of the link mechanism, for example, at least during the engagement of the first and the second coupling.

According to a further embodiment of the invention the first coupling and/or the second coupling is formed by at least one spring. Such a spring has the advantage that it can be elastically deformed. For example, the spring may be deformed during movement from the safety position into the intermediate position, after the couplings have engaged. When disengaging the coupling, the spring can return to the starting position. Furthermore, the first coupling may be moved from the path of travel of the second coupling after it has been disengaged. In particular, the engagement of the first coupling with the second coupling may continue due to the ability to be elastically deformed, for example, by using a spring, if the first coupling and the second coupling move relative to each other in at least one first predetermined direction. With relative movement of the coupling in at least one second direction the coupling may, for example, disengage.

According to a further embodiment the blade holder can be moved opposite the force of a spring from the safety position into the intermediate position, and from the intermediate position into the cutting position. If the blade holder is no longer held in the cutting position by the cutting force, it automatically moves back into the safety position due to the return force of the spring. Even in case the actuator is moved back into the starting position the blade holder pivots back into the safety position as a result of the return force.

According to a further embodiment of the invention the first coupling and/or the second coupling when engaged are elastically deformed during movement from the safety into the cutting position opposite their spring return force, and move back into their starting position during disengagement of the coupling. During the entire movement of the blade holder from the safety into the intermediate position the coupling therefore remain engaged.

During movement of the blade holder into the cutting position the first coupling and the second coupling are disengaged such that the first coupling and/or the second coupling can move back into the starting position as a result of the spring return force thereof. Due to the backward movement into the starting position, the first coupling is not located in the path of travel of the second coupling so that the blade holder can pivot back into the safety position.

BRIEF DESCRIPTION OF THE DRAWING

Further advantages are obvious from one of the embodiments shown in the figures. Therein.

SPECIFIC DESCRIPTION OF THE INVENTION

Figure 1:
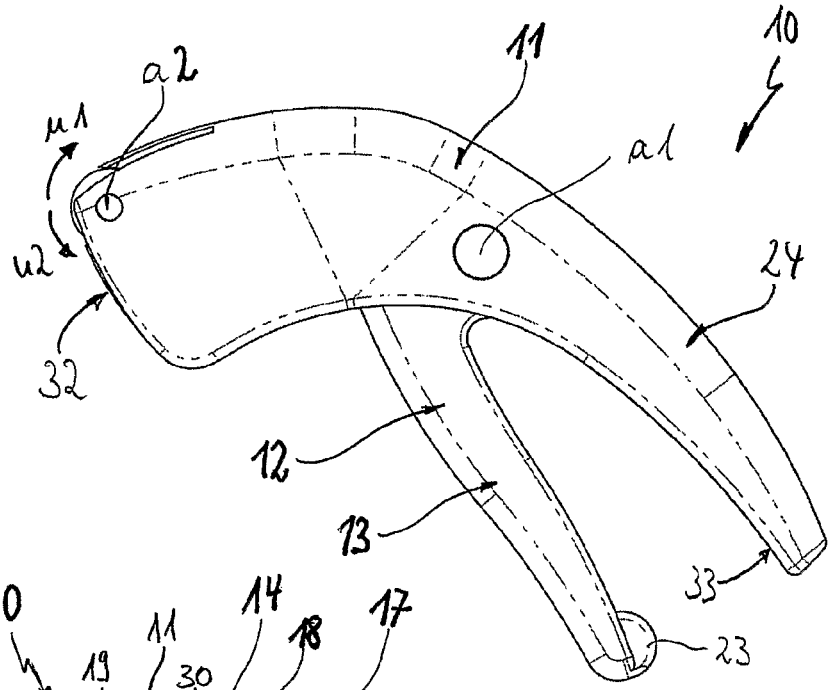
FIG. 1 is a schematic side view of a first embodiment of the safety knife according to the invention in the safety position.

The safety knife is indicated generally at 10 in the drawings. As far as embodiments are shown in the following that deviate from one another, similar features are always denoted by the same reference symbols despite any structural differences.

A first embodiment is shown in FIGS. 1 to 8. According to FIG. 1 the safety knife 10 has a housing 11 and an actuator 12. The actuator 12 is pivotal on the housing 11 about a rotation axis a1 in directions v1 and v2. A grip part 24 of the housing 11 and by a grip part 13 of the actuator 12 can pivot the actuator 12 jaw-like between a starting position shown in FIG. 1 and an actuated position, shown, for example, in FIG. 3.

Figure 2:
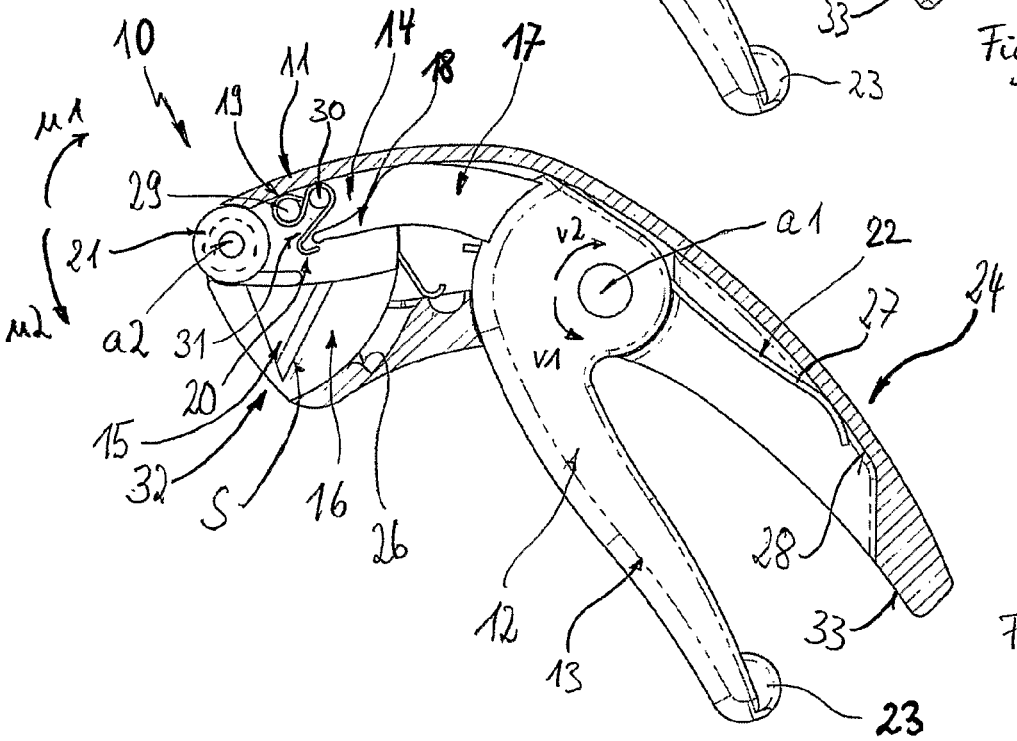
FIG. 2 is a schematic sectional view of the safety knife in the safety position.

According to FIG. 2 the knife 10 has a spring 22 that biases the actuator 12 in the direction v2 toward the starting position. The spring 22 bears on an inside surface 28 of a cavity 16 of the housing 11 with one of its arms 27. The other unillustrated arm of the spring 22 bears on the actuator 12. The actuator 12 is a two-armed lever whose one lever arm is formed by the grip part 13 and whose other lever arm is formed by an operating part 17.

A blade support 14 is pivoted in the cavity 16 about an axis a2 in the directions u1 and u2 on the housing 11. The axis a2 is fixed on the housing 11. A blade 15 having a cutting edge S is held on the blade support 14. In the safety position shown, for example in FIG. 2, the blade 15 is completely within the housing 11 such that injury to the user is impossible.

A beak-shaped nose 18 is integrally molded on the operating part 17. The nose 18 interacts with a spring 19 attached to the blade support 14. The spring 19 is wrapped in an S-shape around two cylindrical pins 29 and 30 integrally molded into the blade support 14 so that the spring 19 is fixed to the blade support 14. At one free end 31 the spring 19 has a U-shaped seat 20 for the nose 18.

In the safety position according to FIG. 2 the seat 20 is in the path of travel of the nose 18 but the nose 18 is not in contact with the spring 19. If the actuator 12 is pivoted from the starting position of FIGS. 1 and 2 in the direction v1 into the actuated position of FIGS. 3 and 4, the nose 18 engages into the seat 20 and pivots the blade support 14 against the force of a spring 21, which is merely indicated schematically by a dotted line, from the safety position in the direction u1 into the intermediate position shown in FIGS. 3 and 4. The spring 19 is thus elastically deformed.

Figure 4:
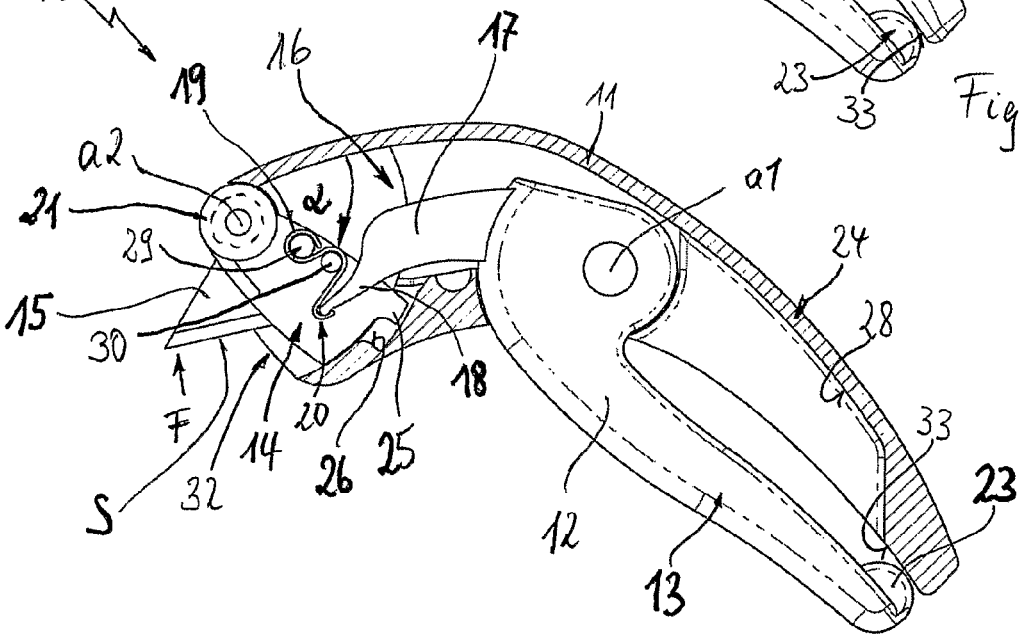
FIG. 4 is a schematic sectional view like FIG. 2 of the safety knife in the intermediate position.

According to FIG. 4 the blade support 14 is pivoted through an angle $\alpha$ into the first cutting position. In the intermediate position the blade 15 projects from an opening 32 of the housing 11.

Figure 3:
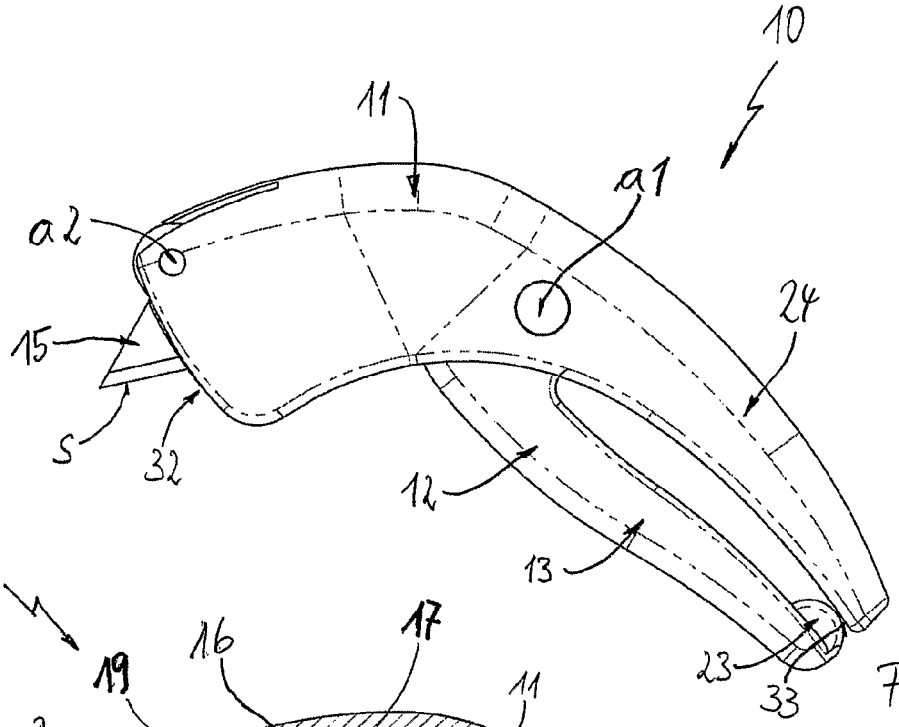
FIG. 3 is a side view like FIG. 1 of the safety knife in an intermediate position.

The actuator 12 in the intermediate position according to FIGS. 3 and 4 is pivoted against the force of the spring 22 (only shown in FIG. 2 for reasons of clarity) so far that a stop 23 provided on the actuator 12 abuts an outer surface 33 of the grip part 24.

Figure 5:
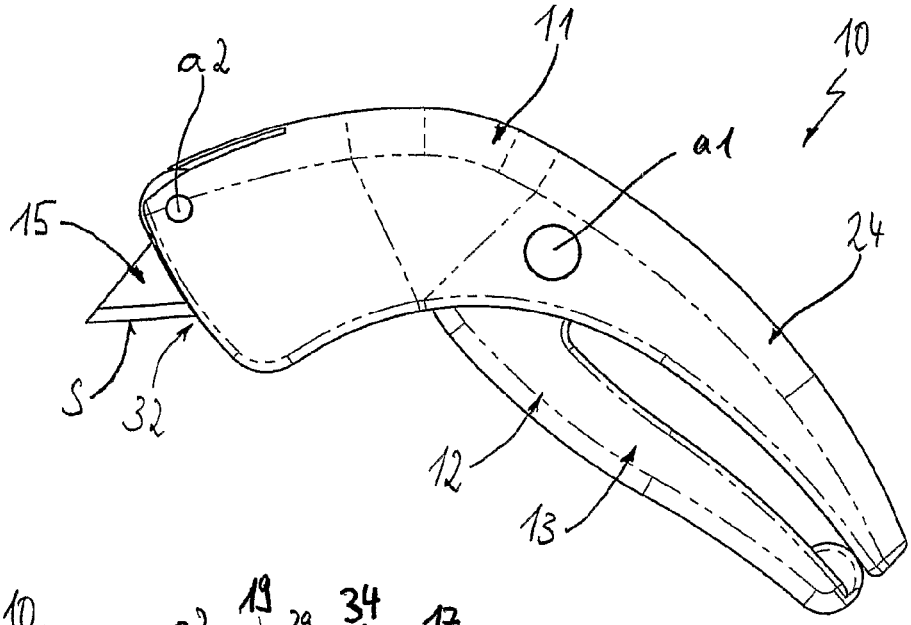
FIG. 5 is a side view like FIG. 3 of the safety knife in a cutting position, a cutting force holding the blade support in the cutting position.
Figure 6:
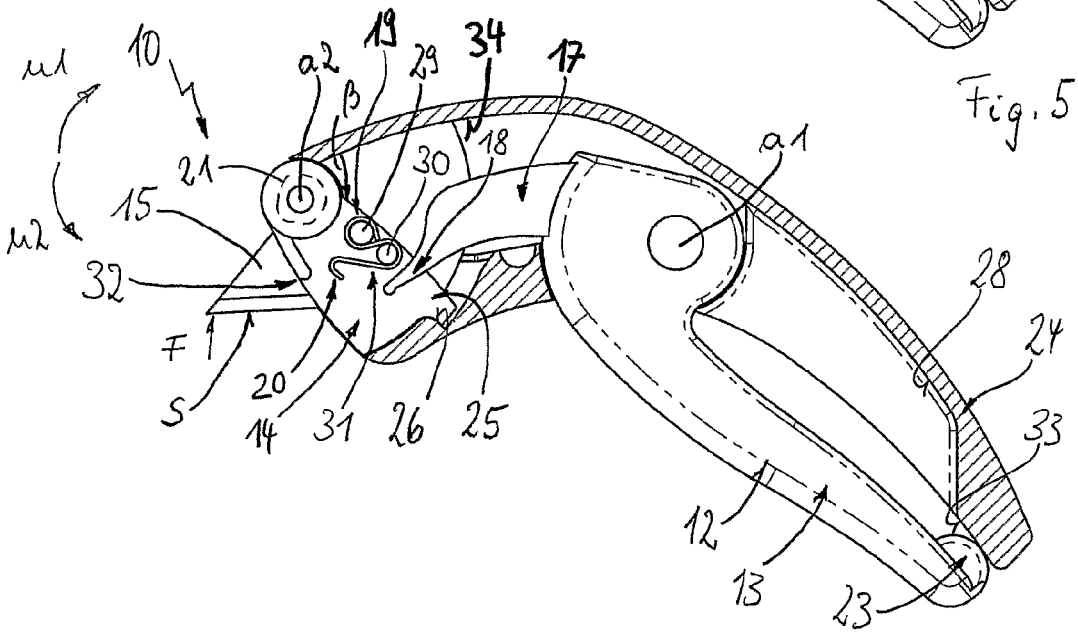
FIG. 6 is a schematic sectional view like FIG. 4 of the safety knife in the cutting position, a cutting force holding the blade support in the cutting position.

A force F acting on the blade 15 pivots the blade support 14 to the cutting position shown in FIGS. 5 and 6 in which a stop projection 25 of the blade support 14 engages a shoulder 26 of the housing and the blade support 14 forms an angle $\beta$ to a housing wall 34. The seat 20 of the spring 19 disengages from the nose 18. The spring 19 can move elastically back into its relaxed position of FIG. 6. The nose 18 is now located outside the path of travel of the seat 20.

Figure 7:
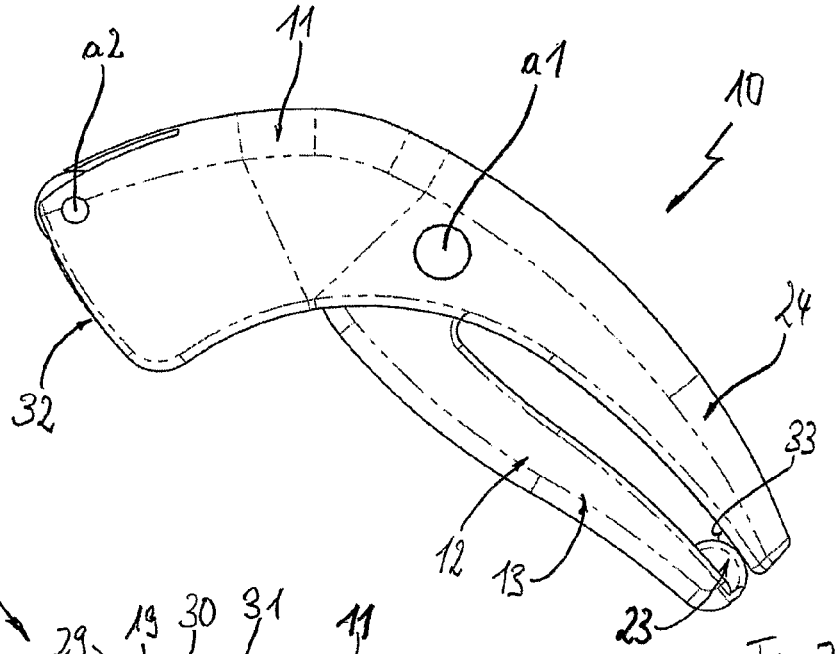
FIG. 7 is a side view like FIG. 5 of the safety knife in the safety position, the actuator being in the actuated position.
Figure 8:
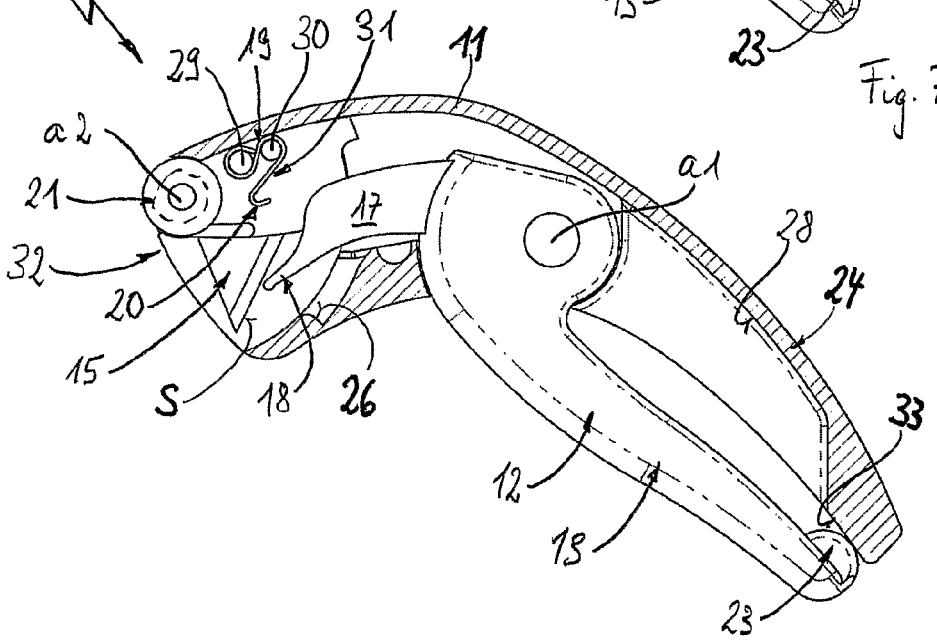
FIG. 8 is a schematic sectional view like FIG. 6 of the safety knife in the safety position, the actuator being in the actuated position.

As soon as the force F acting on the blade 15 is lower than the force of the spring 21 that prestresses the blade support 14 into the safety position, the blade support 14 is pivoted by the spring 21 in the direction u2 into the safety position according to FIGS. 7 and 8 even though the actuator is still in the actuated position. With decreasing force acting on the grip part 17 the actuator 12 is shifted back into the starting position by the spring 22.

Figure 9:
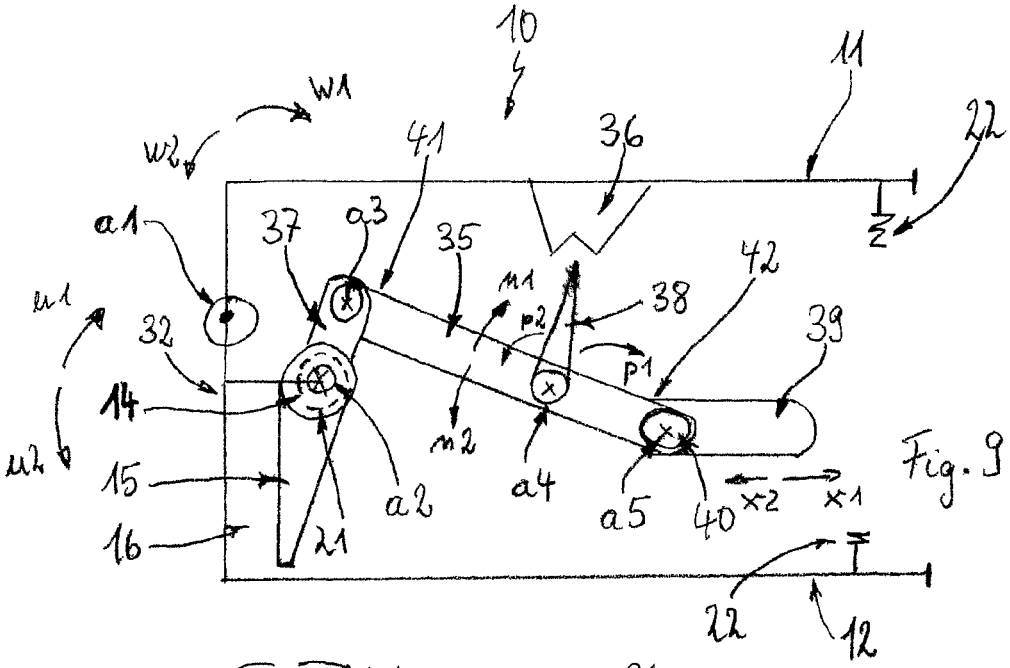
FIG. 9 is a schematic view of a second embodiment of the safety knife according to the invention in the safety position.
Figure 11:
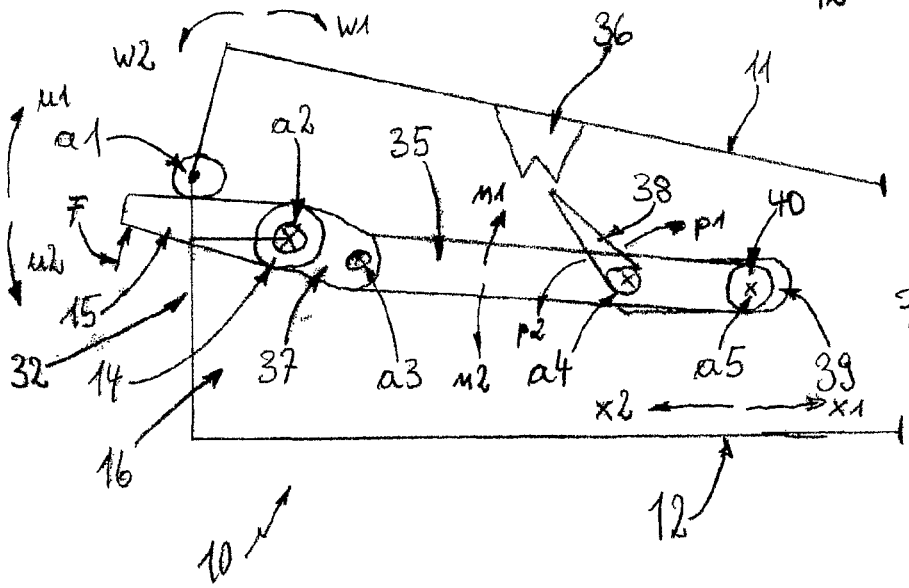
FIG. 11 is a schematic view like FIG. 10 of the safety knife in the cutting position.
Figure 10:
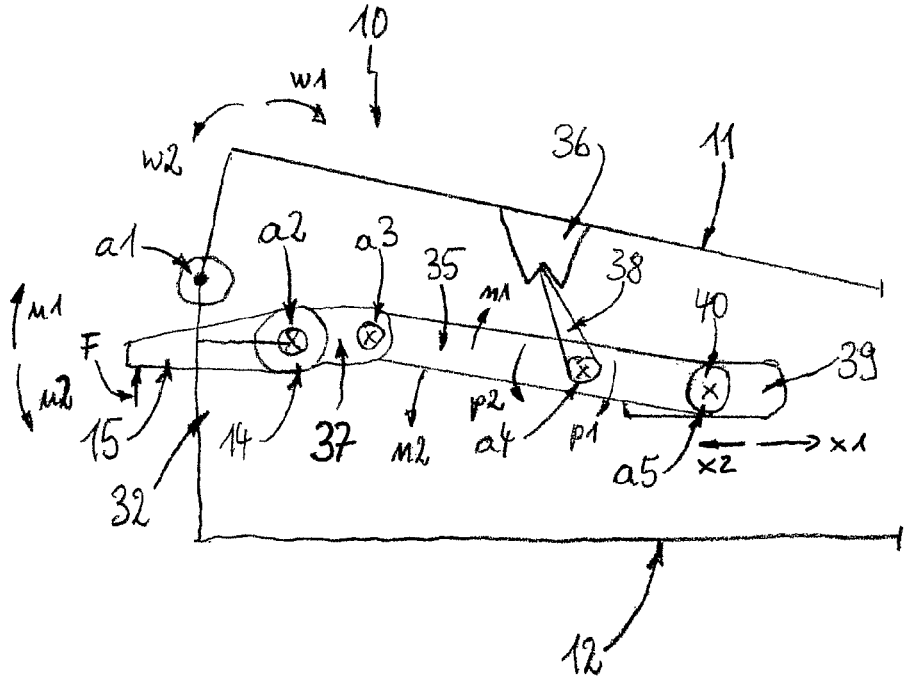
FIG. 10 is a schematic view like FIG. 9 of the safety knife in the intermediate position.

A second embodiment is shown in FIGS. 9 to 11. A primary knife part 11 is pivoted on a secondary knife part 12 by a pivot a1. The primary knife part 11 can therefore moved relative to the secondary knife part 12 from the starting position shown in FIG. 9, for example, against the return force of a spring 22 indicated by a dotted line in a direction w1 into an actuated position shown in FIG. 10. The pivoting of the primary knife part 11 relative to the secondary knife part 12 may be limited by a stop in a manner that is not shown.

A blade support 14 is pivoted on the secondary knife part 12 at a pivot a2. A blade 15 is held on the blade support 14. From the safety position shown in FIG. 9 the blade support 14 can pivot in the direction u1 against a return force of a spring into an intermediate position shown in FIG. 10. The blade support 14 can pivot from the intermediate position in the direction u1 into a cutting position shown in FIG. 11. In the safety position the blade 15 is enclosed in a cavity 16 of the blade 10 where it is inaccessible to a user. In the intermediate position and in the cutting position the blade 15 projects from the cavity 16 through an opening 32.

An extension 37 is firmly connected to the blade support 14. The extension 37 is connected to a first end 41 of a link 35 by a pivot a3. A pin 40 at a second end 42 of the link 35 can pivot in a slot 39 in the directions n1 and n2 and slide in a straight line in directions x1 and x2. Together with the slot 39 the pin 40 forms a joint a5.

Second coupling in the form of a pawl 38 are supported on the link 35 by a pivot a4. The pawl 38 can engage a first coupling in the form of a formation 36. The formation 36 is part of the primary knife part 11.

In the starting position according to FIG. 9 the pawl 38 and the formation 36 are disengaged. If the knife 10 is moved into the actuated position according to FIG. 10, the pawl 38 and the formation 36 engage. For this purpose the pawl 38 is pivoted relative to the link 35 against the force of an unillustrated spring in a direction p1. Due to the contact between the pawl 38 and the formation 36 the link 35 is pivoted into the direction n2 about the axis a5 on movement into the intermediate position. The end 42 of the pin 40 moves in the direction x1 along the slot 39.

Due to the pivoting of the link 35, the blade support 14 connected to the link 35 via the joint a3 pivots in the direction u1 into the FIG. 10 intermediate position in which the pawl 38 and the formation 36 engage each, thus preventing movement of the blade support 14 into the safety position.

A cutting force F acting on the blade 15 pivots the blade support 14 further into the cutting position according to FIG. 11 in the direction u1. The link 35 simultaneously pivots in the direction n2. The pin 40 simultaneously also moves further in the direction x1 along the slot. The pawl 38 then disengages from the formation 36. After disengaging from the formation 36, the pawl 38 pivots in the direction p2 relative to the link 35 as a result of the return force of its unillustrated spring.

The blade support 14 may now be pivoted by the spring from the cutting position according to FIG. 11 into the safety position, since the pawl 38 and the formation 36 are no longer engaged. The blade support 14 therefore will pivot into the safety position as soon as the return force of the spring is greater than the cutting force acting on the blade 15 by the cutting action.

Movement of the blade support 14 into the safety position moves the pin 40 in the direction x2 in the slot 39. The link simultaneously pivots in the direction n1.

Figure 12:
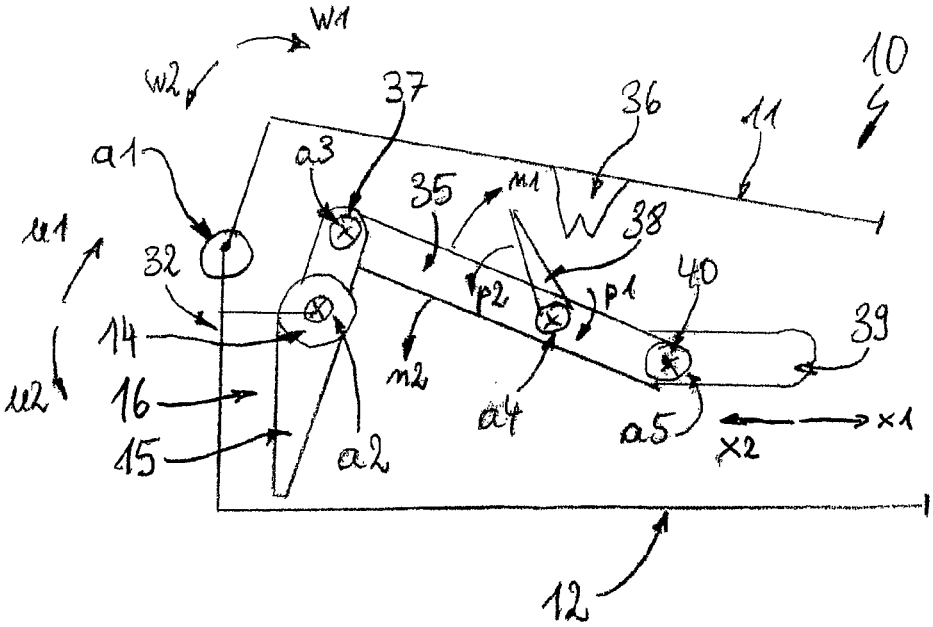
FIG. 12 is a schematic view like FIG. 11 of the safety knife in the safety position, the actuator being in the actuated position.

Movement of the blade support 14 from the cutting position into the safety position takes place after disengagement of the coupling from each other, even if the primary knife part 11 and the secondary knife part 12 remain in the actuated position according to FIGS. 10 and 11 (see FIG. 12).

If force is no longer applied to the primary knife part 11 and the secondary knife part 12 by a user, the primary knife part 11 moves back into the starting position according to FIG. 9 in a direction w2 relative to the secondary knife part as a result of the return force of the spring 22.

The invention claimed is:

1. A knife comprising:

a blade support holding a blade;

a primary knife part;

a secondary knife part movable relative to the primary knife part and forming with the primary knife part a housing on which the blade support is pivotal about an axis fixed on the primary knife part;

a first coupling associated with the blade support;

a second coupling associated with the secondary knife part and detachably engageable with the first coupling in order to pivot the blade support as a result of movement of the primary knife part relative to the secondary knife part between a safety position in which the blade is retracted into the knife housing inaccessible to the user, and an intermediate position in which the blade projects from the knife housing; and a return spring biasing the blade support pivotally about the axis with a return force into the safety position such that a cutting force on the blade pivots the blade support about the axis out of the intermediate position into a cutting position in which the first coupling and the second coupling are disengaged from each other such that the blade support is pivoted by the return spring into the safety position.

2. The knife according to claim 1, wherein the blade support carries the first coupling part or the second coupling part.

3. The knife according to claim 1 wherein the first coupling or the second coupling is a formation that is firmly connected to one of the knife parts.

4. The knife according to claim 1 wherein actuating means are associated with the first coupling or the second coupling for actuating the blade support.

5. The knife according to claim 4, wherein the actuating means is associated with a lever having a fixed axis with regard to the primary knife part or the secondary knife part.

6. The knife according to claim 4, wherein the actuating means at least partially forms one of the couplings.

7. The knife according to 6 wherein the first coupling is mounted on the blade support.

8. The knife according to claim 1, wherein the first coupling and/or the second coupling are associated with at least one spring.

9. The knife according to claim 8, wherein the spring can be elastically deformed during movement from the safety position into the intermediate position against a return force, and can be moved back into the starting position thereby by the elastic return force upon disengaging the first coupling from the second coupling.

10. A knife comprising:

a primary part;

a secondary part movable relative to the primary part between an actuated position and a rest position;

a support holding a blade and pivotal at an axis fixed on one of the parts between a safety position with the blade fully retracted into the one part and a cutting position with the blade projecting from the housing and through an intermediate position with the blade projecting partially from the housing and between the cutting and safety positions, the blade being oriented on the support such that, when engaged with a workpiece to be cut in the intermediate position, a cutting motion shifts the support and blade into the cutting position;

respective coupling formations on the blade support and secondary part, one of the coupling formations moving relative to the other formation along a travel path on relative movement of the primary and secondary parts between the actuated and rest positions to engage and move the other coupling formation and pivot the support about the axis from the safety to the intermediate position;

first spring means for biasing the other of the coupling formations into a position in the travel path when the support is generally in the safety position and a position clear of the travel path of the other coupling formation when the support is generally in the cutting position, the coupling formations disengaging from each other on movement of the blade support from the intermediate to the cutting position; and second spring means for biasing the support into the rest position when the support is in the cutting position, whereby the support and blade retract automatically into the safety position when a force exerted by the workpiece on the blade is less than an opposite force exerted by the second spring means on the blade.

11. The knife defined in claim 10 wherein the first spring means is a spring forming the one coupling formation.

12. The knife defined in claim 11 wherein the other coupling formation is an entrainment nose formed on one of the parts.

13. The knife defined in claim 10 wherein the one coupling formation is a hook formed at the end of the spring.

14. The knife defined in claim 10 wherein the two parts are pivoted together about an axis fixed on the two parts.

15. The knife defined in claim 14 wherein the support is pivoted on one of the parts and carries the one coupling formation, the other coupling formation being formed on the other of the parts.

* * * * *